US005562519A

United States Patent [19]

Loewenton

[11] Patent Number: 5,562,519

[45] Date of Patent: Oct. 8, 1996

[54] PANEL, DOWEL AND BLOCK CONSTRUCTION KIT

[76] Inventor: Edward Loewenton, P.O. Box HC 132, Morrisville, Vt. 05661

[21] Appl. No.: 288,622

[22] Filed: Aug. 10, 1994

[51] Int. Cl.[6] ..... A63H 33/08

[52] U.S. Cl. ..... 446/126; 446/105; 446/108; 446/122

[58] Field of Search ..... 446/103, 105, 446/126, 108, 122

[56] References Cited

U.S. PATENT DOCUMENTS

| | | | |
|---|---|---|---|
| 1,242,272 | 10/1917 | Thurman | 446/105 |
| 1,242,273 | 10/1917 | Thurman | 446/105 |
| 1,436,710 | 11/1922 | Gruenberg | 446/105 |
| 1,870,978 | 8/1932 | Wolfe | 446/105 |
| 1,915,835 | 6/1933 | Pajeau | 446/126 |
| 1,916,634 | 7/1933 | Pajeau | 446/126 |
| 2,208,049 | 7/1940 | Pajeau | 446/126 |
| 2,313,357 | 3/1943 | Pajeau | 446/126 |
| 4,326,354 | 4/1982 | Hagberg | 446/126 |
| 5,013,245 | 5/1991 | Benedict | 446/126 |

FOREIGN PATENT DOCUMENTS

| | | | |
|---|---|---|---|
| 52063 | 8/1936 | Denmark | 446/126 |
| 780230 | 4/1935 | France | 446/105 |

*Primary Examiner*—Robert A. Hafer
*Assistant Examiner*—Jeffrey D. Carlson
*Attorney, Agent, or Firm*—Peter F. Corless; Cara Z. Lowen

[57] ABSTRACT

The invention includes a minimally structured, abstract toy with a plurality of nonrepresentational interconnecting pieces comprising: a plurality of connectors; a plurality of blocks which are adapted to receive one or more of the connectors so that the blocks move freely along the connectors; a plurality of hubs, each having a plurality of openings to receive a connector, one opening centrally positioned and a plurality of additional locking openings peripherally located, preferably tapered inwardly (i.e., openings that have a diameter that decreases with depth) to produce an opening to firmly receive the connectors; a plurality of spacers each having an opening to receive a connector; and a plurality of stationary pieces, each containing at least one locking opening, the sides of the opening inwardly tapered to produce an opening that has a diameter that decreases with depth.

16 Claims, 5 Drawing Sheets

PANEL, DOWEL AND BLOCK CONSTRUCTION KIT

FIELD OF THE INVENTION

The present invention relates to a three-dimensional design and construction toy.

BACKGROUND OF THE INVENTION

Toys currently exist which enable a user to build functional structures by interconnecting different pieces. However, these inventions have inherent limitations.

For example, a toy has been produced which contains three types of pieces which can be connected together to build planar structures. The pieces include dowel-shaped connectors, stoppers and movable pieces. The movable pieces are in the shape of blocks, cylinders and rings and have openings which allow them to slide along or rotate around the connectors. The stoppers are ball-shaped and have openings smaller than the diameter of the connector, to produce a tight fit when the connector is inserted. To utilize this toy, the movable elements are strung onto the connectors. The connectors are then inserted into the stoppers to prevent the movable pieces from sliding off the connectors.

This toy, however, does not have the capacity to produce three-dimensional structures. The block-shaped movable pieces have two openings in the same plane only. Therefore, structures built with this toy are limited to single plane constructions.

Other toys, such as Legos, enable a user to build structures by connecting plastic units together which have interlocking parts. However, these toys are very modular and therefore limit the amount of deduction and planning necessary to build a functional structure. Also such toys generally do not contain movable assembled pieces. Any movable pieces present are merely representational and therefore their functions are already defined. As a result, this toy is very limiting.

Similarly, with Tinker Toys a user can assemble structures from certain components. However, the function of each of the components is so well defined that the use of each part is very narrow. The parts that allow kinetic function are also narrowly defined. This toy also lacks non-representational movable parts and multiple shapes, and therefore limits a user's ability to design and construct complicated and functional structures.

It is therefore desirable to have a new toy which enables a user to design and construct complex functional structures from abstract, non-representational components. It would be particularly desirable to have a new toy that allows creation of three-dimensional structures with non-representational movable parts.

SUMMARY OF THE INVENTION

The invention includes a minimally structured, abstract toy with a plurality of nonrepresentational interconnecting pieces such that a user can design a device and then connect the pieces together to create a structure with the desired function. The pieces can be combined to create a predesigned three-dimensional structure depicted in an illustration provided by the manufacturer, or alternatively, the user can design and create his own structures.

The present invention has pieces with multiple shapes and sizes, and produces more functional structures than existing toys. This invention requires more deduction and planning and therefore is a better educational tool for developing reasoning and design skills.

In a preferred embodiment, the toy of the invention comprises:

1. a plurality of connectors;
2. a plurality of blocks which are adapted to receive one or more of the connectors so that the blocks move freely along the connectors;
3. a plurality of hubs, each having a plurality of openings to receive a connector, one opening centrally positioned and a plurality of additional locking openings peripherally located, preferably tapered inwardly (i.e., openings that have a diameter that decreases with depth) to produce an opening to firmly receive the connectors;
4. a plurality of spacers each having an opening to receive a connector; and
5. a plurality of stationary pieces, each containing at least one locking opening, the sides of the opening inwardly tapered to produce an opening that has a diameter that decreases with depth.

Preferably, the toy of the invention comprises dowel-shaped and panel-shaped connectors which interlock with hubs and stationary pieces such as stoppers and bases. The dowel-shaped connectors have tapered ends.

The hubs preferably include two different types of pieces. In the locking hubs, the hub has a centrally positioned opening which creates a tight fit with a dowel when it is inserted into this opening, thereby locking the dowel in place, but which also allows the dowel to be easily removed. In the locking hub, the central opening can be either bored through the hub with tapered sides to create an interior diameter slightly smaller than that of the dowel connector or, alternatively, a blind opening with tapered sides. In the other type of hub, the hub has an opening bored through the center with a diameter greater than the dowel to enable it to move freely on the dowel.

As used herein, "move freely" or similar term used in reference to a component of a toy of the invention means the component can easily spin and slide along a dowel component by hand manipulation of a user. Typically a component that moves freely around a dowel component piece has an opening that has a width at least about 1.1 times, more typically at least about 1.5 times greater than the width of the dowel component. The pieces which are capable of this "free movement" are also sometimes referred to herein as "movable pieces" or "movable parts."

All hubs also have peripheral openings with tapered sides to receive additional dowel connectors enabling three-dimensional construction. The hubs may also have grooves to accommodate the panel connectors.

Hereinafter, an opening referred to as "centrally positioned" means an opening which is located at the approximate geometric center of the flat surface of the piece. Similarly, an opening referred to as "peripherally located" means an opening located proximate to the exterior side surfaces of the piece, distal to the center of the piece. As made clear herein, the combination of holes in these two positions can enable a user to insert dowel connectors at right angles, resulting in three dimensional construction.

The stoppers are preferably ball-shaped pieces with one opening which creates a tight fit when the dowel connector is inserted. The base is preferably a flat piece with more than one opening to provide a steady working surface and to enable the user to build upwards. The base can also be mounted on a wall to enable the user to build outward.

The toy of this invention also contains blocks and spacers with passages that are larger than the diameter of the dowel connectors, enabling these pieces to slide or spin along the connectors. The blocks have passages through more than one plane to enable three-dimensional construction, as well as grooves to receive the panel connectors. Some blocks may also have a locking opening to enable them to lock onto the dowels. Suitable shapes of spacers include, e.g., cylinders and rings. The cylinders and rings preferably function as spacers between other movable parts, thereby allowing particular placement of the movable parts.

During typical use of a toy of the invention, one or more movable pieces, such as blocks, hubs or spacers, are placed on the connectors in the desired order. The spacers are used to hold the movable pieces in place along the dowel connector. A locking piece such as a hub, or a stopper, can then be attached to the connector to prevent the movable pieces from sliding off the dowel. If a locking hub is used, an additional connector can be inserted into the peripheral openings of the hub, or to the other side of the central passage, and more movable pieces can be strung along that second connector. Or, an additional connector can be inserted into an opening on a block located on the first dowel, and more pieces strung along the dowel. A hub or stopper is then attached to the end of the second connector. Alternatively, the connector can be inserted into a base. This process continues until the user has completed the desired structure.

The user can utilize this toy to design and build structures with complex designs and functions. The resulting structures are three-dimensional, colorful and contain numerous movable parts. The abstract, non-representational nature of the pieces force the user to carefully plan and design the desired structure and therefore, this toy can be used by children of all ages to develop coordination, as well as reasoning and spatial skills.

The components of a toy of this invention are preferably fabricated completely or substantially from wood and colored with non-toxic dyes. However, other materials such as plastic, metal and the like can be used to fabricate toy components.

These and other features and objects of the invention will be readily understood from the following detailed description of the invention which should be read in light of the accompanying drawings.

BRIEF DESCRIPTION OF THE DRAWINGS

A more complete understanding of the invention may be provided by reference to the accompanying Drawing in which like reference numbers refer to like elements throughout the various figures.

DETAILED DESCRIPTION OF THE INVENTION

In one aspect the invention can be characterized as a toy with interconnecting pieces of various shapes and functions that enables one to design and create abstract or functional structures.

Figure 1A:
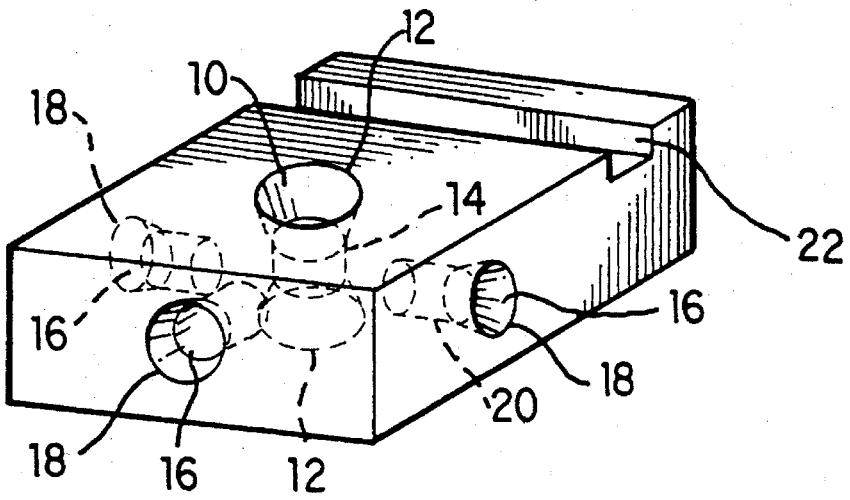
FIG. 1 (*a*), (*b*) and (*c*) depicts an angled side view of a hub, and cross-sectional view of a locking hub.
Figure 1B:
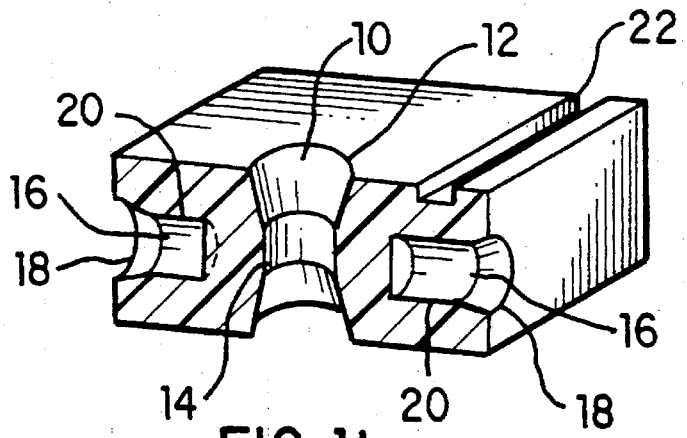
Figure 1C:
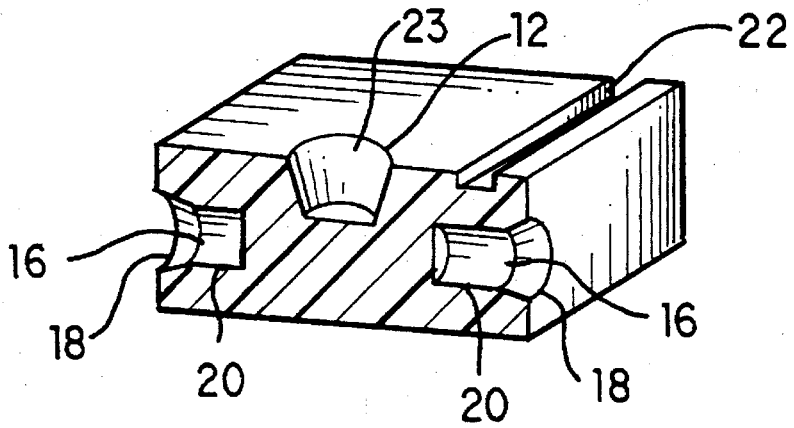

Referring now to the Drawings, FIG. 1 (*a*) shows a locking hub of the invention. The hub, as pictured, has a central opening 10 bored through it, creating a passage. The passage is tapered slightly so that the diameter of the opening 12 on each side of the hub piece is larger than the diameter in the interior portion 14 of the passage. The hub piece has an opening 16 on each peripheral side. Suitably, the depth of opening 16 may be approximately ½". The opening is tapered slightly so that the outer diameter of the opening 18 is larger than the diameter in the interior portion 20 of the opening. For instance, an example would be an opening with an outer diameter of 15/32" and a diameter of 13/32" in the interior portion. One or more grooves 22 runs along the surface of the hub. The width of the groove is cut to provide a tight fit with the panel member depicted in FIG. 4. FIG. 1 (*b*) shows a cross-section of the hub and the tapered opening 10 and peripheral blind openings 16. FIG. 1 (*c*) shows an alternative to the tapered passage shown in 1 (*a*) and 1 (*b*) and consists of blind opening 23 which is tapered.

Figure 2:
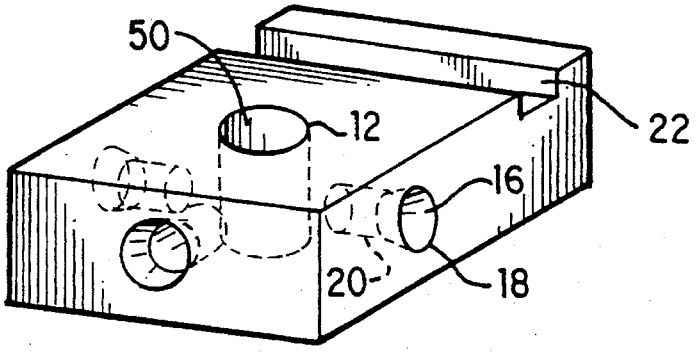
FIG. 2 depicts a spinning hub.

FIG. 2 shows a spinning hub with a central opening 50 which has a diameter greater than the diameter of the dowel.

Figure 3:
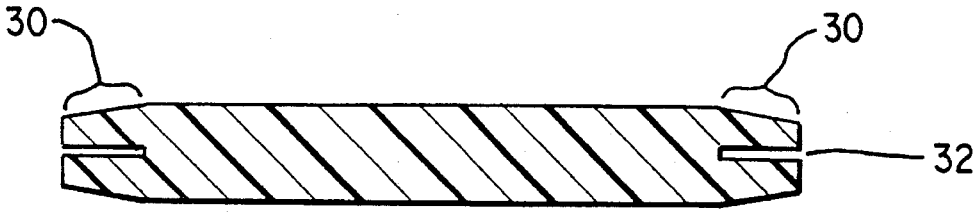
FIG. 3 depicts a cross-sectional view of a dowel connector.
Figure 4:
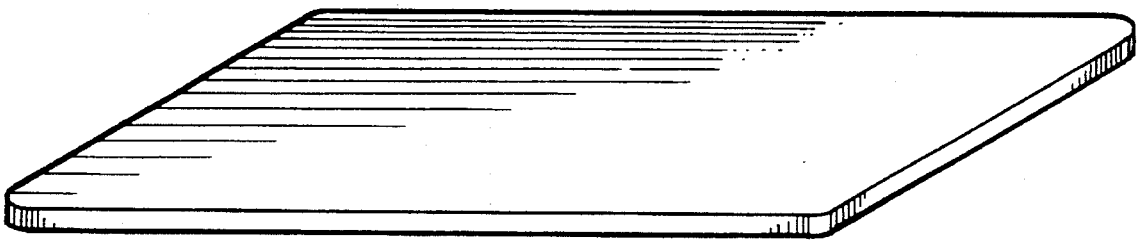
FIG. 4 depicts an above view of a panel connector.

Suitable connecting pieces are shown in FIGS. 3 and 4. FIG. 3 shows a dowel piece which has tapered ends 30 and a slit 32 cut into the ends to allow insertion of these ends into the tapered openings of the other pieces. The ends of the dowels create a tight fit with these openings enabling the pieces to lock onto the dowel connectors.

Figure 5:
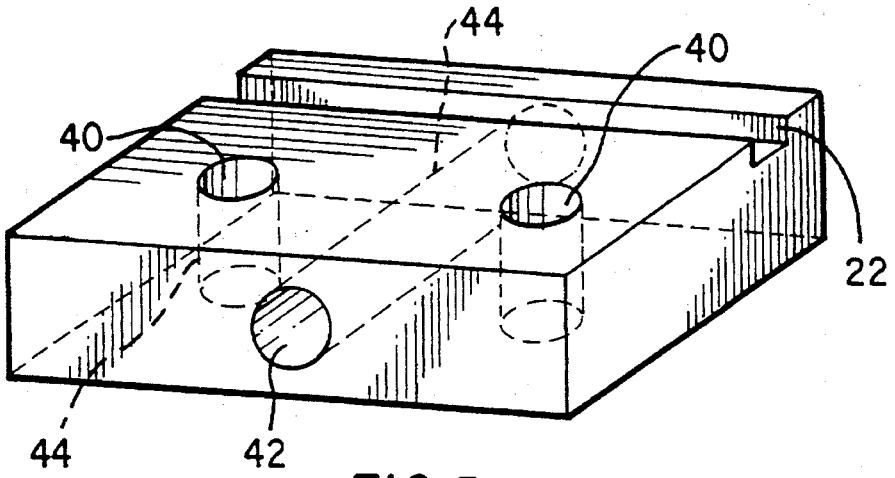
FIG. 5 depicts a spinning block.

The panel connectors in FIG. 4 preferably fit tightly into the grooves 22 on the hubs and the blocks shown in FIG. 5.

FIG. 5 shows a spinning block which has openings 40, 42 through two planes. The two outermost openings 40 are in the same plane and perpendicular to the plane of the central opening 42. The diameters 44 of each of these openings is greater than the diameter of the dowel connector to enable the piece to swing, rotate and slide freely along the connector. Alternatively, at least one of the outermost openings can be a locking opening as illustrated in FIGS. 1 (*b*) and 1 (*c*) to make a locking block.

Figure 6:
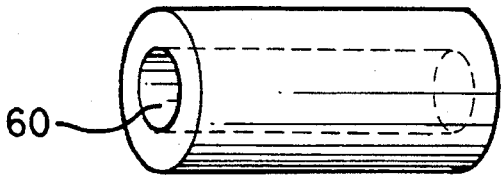
FIG. 6 depicts a cylindrical spacer.
Figure 7A:
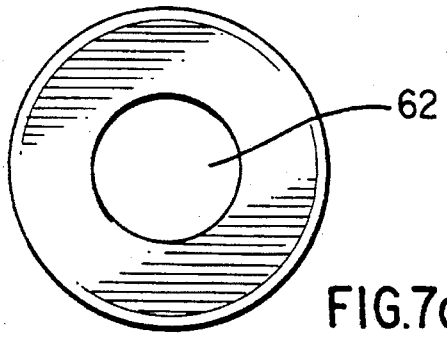
FIG. 7 (*a*) shows a plan view and (*b*) shows a side view of a ring-shaped spacer.
Figure 7B:
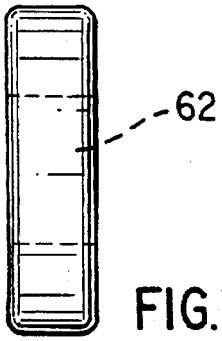
Figure 8A:
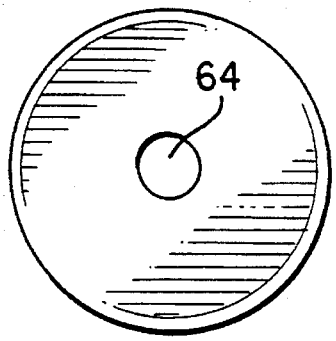
FIG. 8 (*a*) shows a plan view and (*b*) shows a side view of a wheelshaped spacer.
Figure 8B:
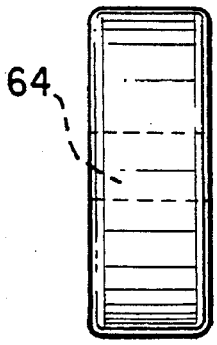

The cylindrical spacer depicted in FIG. 6 and the ring-shaped spacer in FIG. 7 position the movable pieces on the dowel connectors. The cylinder has a passage 60 along its central axis which has a diameter greater than the diameter of the dowel connecter. The ring has an opening or passage 62 through its center. FIG. 7 (*a*) shows a plan view and (*b*) shows a side view of a ring-shaped spacer. FIG. 8 depicts a wheel shaped piece with an opening 64 through its center which has a diameter greater than the diameter of the dowel connecter. FIG. 8 (*a*) shows a plan view and (*b*) shows a side view of a wheel shaped spacer.

Figure 9:
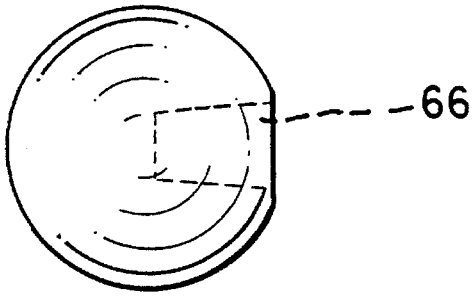
FIG. 9 depicts a ball-shaped stopper piece.

FIG. 9 depicts a ball-shaped stopper piece with a tapered opening 66. The stopper fits tightly onto the ends 30 of the connector pieces to prevent the moveable pieces from sliding off the connector.

Figure 10:
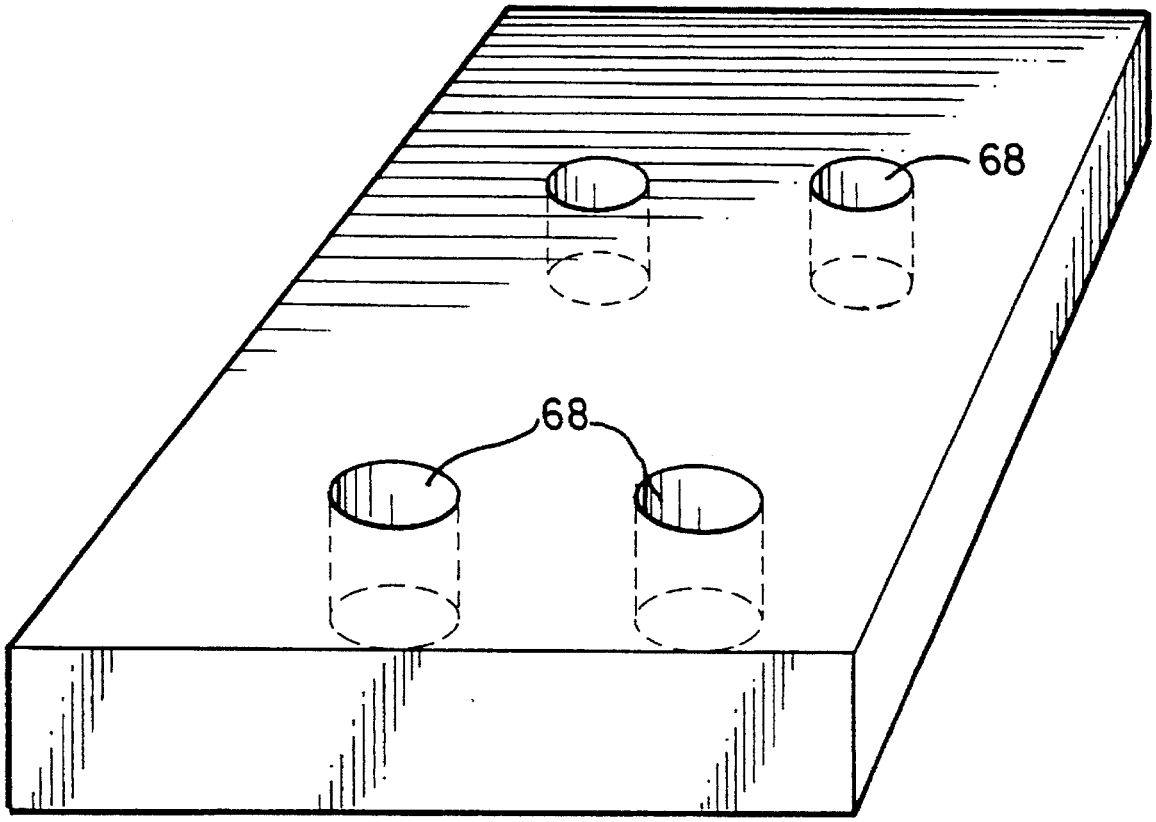
FIG. 10 depicts a stationary board to be used as a stand.

FIG. 10 depicts a stationary board to be used as a base. The base has more than one opening 68 to enable the connector to be inserted, creating a base for the structure.

Figure 11:
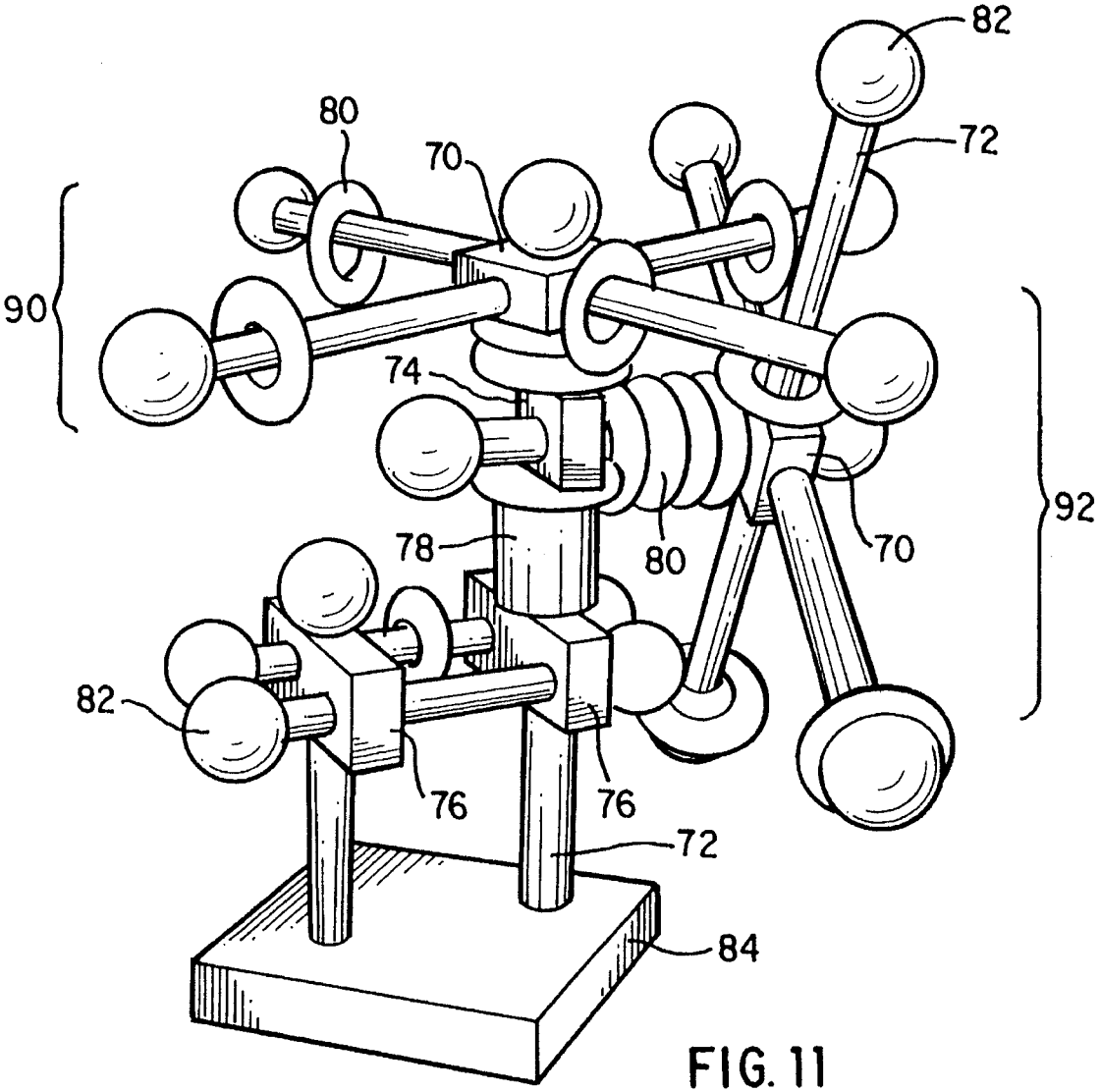
FIG. 11 depicts a three-dimensional structure built using the components of the invention.

FIG. 11 shows one exemplary structure built from the components of the invention, including locking hubs 70, dowel connectors 72, spinning hubs 74, blocks 76, cylindrical spacers 78, ring shaped spacers 80, stoppers 82 and a base 84. When the user turns the top horizontal gear 90, the vertical gear 92 turns as well.

To assemble the toy of the invention, a user may first design a structure which incorporates some or all of the pieces of the toy. Alternatively, the user may freely create a structure as components are joined. In one design scheme, a user may select a dowel shaped member from the group of connectors. He or she then assembles one or more movable pieces along a dowel shaped member, which has a tapered first and second end. The movable pieces can be separated and positioned using the spacer pieces provided. The user then inserts the first end of the dowel member into a stationary piece and the second end of the dowel member into a movable piece or the locking holes of a hub. This process is repeated until the desired structure is complete. The subsequent connectors can be inserted into the passages in the blocks or hubs on the initial dowel to build into another plane in order to get a three-dimensional structure.

The components of this invention are preferably fabricated from wood and colored with non-toxic dyes. However, other materials could be used such as plastic.

The specific shapes of the pieces can vary. The hub piece can suitably be of a number of configurations. Preferably, the hub is square, or round, more preferably the hub has rotational symmetry about a center point. The connectors can suitably be of a number of configurations, preferably dowel and panel shaped. The blocks can suitably be rectangular, square, round, spherical or triangular, more preferably the blocks are rectangular. The stoppers can suitably be of a number of different shapes, preferably spherical, square, or triangular. More preferably, the stoppers are round. The spacers can suitably be of a number of shapes, preferably cylinders, rings, balls, squares, or rectangles. More preferably the spacers are cylinders and rings.

The specific dimensions and the numbers of the various pieces can vary depending on the size and complexity of the structures to be designed, and the materials used, and can be readily determined by those skilled in the art based on the disclosure provided herein.

Suitably, the size of the hub pieces can be from: a length from about 1" to 4", more preferably from about 1 and ½" to 2", a width of from about 1" to 4", more preferably from about 1 and ½" to 2", and a height of about ½" to 3 and ½", more preferably from about 10/16" to 1 and ½". The openings of the pieces suitably have a diameter of from about ⅛" to 2", more preferably from about ¼" to 1". The dowel connectors can suitably be a variety of lengths, preferably, from about 2" to 20", more preferably, from about 4" to 15". The panel connectors can suitably be a variety of sizes, with a range as follows: a length from about 3" to 12", more preferably from about 5" to 8", a height of from about 1" to 5", more preferably from about 1" to 3", and a width of about 1/16" to 1", more preferably from about 2/16" to ½". The size of the blocks can range as follows: a length from about 2" to 8" more preferably from about 3" to 5", a width of from about 1" to 4", more preferably from about 1 and ½" to 2", and a height of about ½" to 3 and ½", more preferably from about 10/16to 1 and ½". The size of the cylindrical spacers can suitably have a length of from about ½" to 4", more preferably a length from about 1" to 2", and a diameter from about ½" to 3", more preferably from about 1" to 2". The size of the ring spacer can range as follows: an outer diameter from about ½" to 3", more preferably from about 1" to 2, and an inner diameter from about ½" to 1 and ½", more preferably from about ⅝" to 1". The stopper may be substantially ball-shaped with a diameter ranging from about ½" to 4", more preferably from about 1" to 2". The size of the base can range as follows: a length from about 2" to 5' more preferably from about 3" to 1', a width of from about 2" to 5', more preferably from about 3" to 1', and a height of about ½" to 3 and ½", more preferably from about 10/16" to 1 and ½". The number of holes in the base can range from about 1 to 50, more preferably from about 2 to 10. These dimensions are merely provided as examples and should not be read as limiting the invention in any way.

One particularly preferred embodiment of the invention is a toy whose parts are made out of wood. The hub pieces are fashioned out of wood blocks 1 and ¾"×1 and ¾"×15/16". The central opening has a diameter of 15/32" and the four peripheral openings, one on each side, are ½" deep, tapered from 15/32" to 13/32" in diameter. The locking hubs have a central opening which tapers to 13/32". The dowel connectors are either 5", 6" or 11'. The ends of the dowel are tapered from a diameter of 7/16" to 13/32" with a slit of ½" in length. The panel connectors are 6"×1 and ⅞"×3/16". The blocks are 3 and ⅛"×1and ¾"×13/16" and the diameter of the three openings is 15/32" except for the locking opening, if present, which is ½" deep, tapered from 15/32" to 13/32" in diameter. The groove in the hub and blocks is ⅛". The cylindrical spacers are 1 and ½" long with a 1 and ¼" diameter. The opening has a diameter of 15/32", which is wider than the dowel. The ring spacer has an outer diameter of 1 and 13/16" and an inner diameter of ⅞". The length of four rings placed side by side is equal to the length of one cylinder. The stopper is shaped like a ball with a diameter of 1 and ¼" and an opening ½" deep and a diameter tapered from an outer diameter of 15/32" to 13/32". The base is 4 and ½"×4and ½"×13/16" and has four openings, each ½" deep.

Suitably, the total number of pieces can range greatly, for instance from 50 to 250 pieces, with varying numbers of different pieces. The more pieces involved, the greater complexity of structures built. More specifically, a toy of this invention suitably contains: from about 1 to 20 hub pieces, more typically from about 2 to 6 hub pieces; from about 5 to 50 dowel connectors, more typically from about 10 to 30 dowel connectors; from about 1 to 15 panel connectors, more typically from about 1 to 5 panel connectors; from about 2 to 20 blocks, more typically from about 3 to 10 blocks; from about 1 to 20 cylinder spacers, more typically from about 3 to 10 cylinder spacers; from about 10 to 50 ring spacers, more typically from about 15 to 30 ring spacers; from about 10 to 50 stoppers, more typically from about 15 to 30 stoppers; from about 2 to 20 wheels, more typically from about 4 to 12 wheels; and from about 0 to 4 bases, more typically from about 1 to 2 bases.

In a preferred embodiment there are 8-5", 4-6" and 1-10" dowel connectors, 1 panel connector, 2 hub pieces, 4 blocks, 3 cylinders and 20 rings, 16 stoppers, 4 wheels and 1 base. Again, these numbers are provided as examples and are not intended to limit the invention in any way.

The designation" set next to a number herein in accordance with its conventional meaning to refer to inches, that is, for example, 5" means 5 inches herein.

The foregoing description of the present invention is merely illustrative thereof, and it is understood that variations and modifications can be made without departing from the spirit or scope of the invention as set forth in the following claims.

What is claimed is:

1. A toy comprising:

(a) a plurality of connectors at least a portion of which comprise a plurality of longitudinally extending dowel shaped connectors and at least another portion of which comprise at least one panel shaped connector, each dowel shaped connector having a tapered first and second end;

(b) a plurality of blocks which are adapted to receive one or more of the connectors and having at least one opening larger than the dowel shaped connectors through each of two perpendicular planes to receive one of said dowel shaped connector, so that the blocks may move freely along the dowel shaped connector, at least a portion of the blocks having a groove to receive one of said panel connectors;

(c) a plurality of hubs, each having a plurality of openings to receive one of said dowel shaped connectors, one opening centrally positioned and a plurality of additional locking openings peripherally located, the locking openings tapered inwardly to produce an opening to create a tight fit with the tapered ends of the dowel shaped connectors;

(d) a plurality of spacers each having an opening to receive one of said dowel shaped connectors so that the spacers move freely along the dowel shaped connector; and (e) a plurality of stationary pieces, each containing at least one locking opening, the sides of the locking opening inwardly tapered to create a tight fit with the ends of the dowel shaped connectors.

2. The toy of claim 1 wherein at least a portion of the blocks further comprise a locking opening to create a tight fit with one of said dowel shaped connectors when one end of the dowel shaped connector is inserted into the locking opening, thereby locking the dowel in place.

3. The toy of claim 2 wherein the locking opening comprises an opening bored through the block and has tapered sides resulting in an interior diameter smaller than that of the dowel connector.

4. The toy of claim 2 wherein the locking opening of the blocks is a blind opening with tapered sides resulting in an interior diameter smaller than that of the dowel shaped connector.

5. The toy of claim 2 wherein at least a portion of the hubs has a groove to receive one of said panel connectors.

6. The toy of claim 5 wherein the opening centrally positioned in at least one of the hubs is a locking opening which creates a tight fit when one end of one of said dowel shaped connectors is inserted into the locking opening.

7. The toy of claim 6 wherein the centrally positioned locking opening of the hub comprises an opening bored through the hub and has tapered sides resulting in an interior diameter smaller than that of the dowel connector.

8. The toy of claim 10 wherein the centrally positioned locking opening of the hubs comprises a blind opening with tapered sides resulting in an interior diameter smaller than that of the dowel shaped connector.

9. The toy of claim 6 wherein the opening centrally positioned is bored through the hub with a diameter greater than the dowel shaped connector to enable it to move freely on the dowel.

10. The toy of claim 9 further comprising wheel-shaped pieces which have an opening centrally positioned having a diameter larger than the diameter of the dowel shaped connectors so that the wheel-shaped pieces may move freely along the dowel shaped connectors.

11. A method of playing with the pieces of a toy comprising:

(a) providing a toy comprising (i) a plurality of dowel shaped and panel shaped connectors;

(ii) a plurality of blocks which are adapted to receive one or more of the dowel shaped connectors so that the blocks may move freely along the dowel shaped connectors and at least a portion of the blocks further having a groove to receive one of said panel shaped connectors;

(iii) a plurality of hubs, each having a plurality of openings to receive one of said dowel shaped connectors, one opening centrally positioned and a plurality of additional locking openings peripherally located, the locking openings tapered inwardly to produce an opening to create a tight fit with the ends of the connectors, and at least a portion of the hubs further having a groove to receive one of said panel shaped connectors;

(iv) a plurality of spacers each having an opening to receive one of said dowel shaped connectors so that the spacers move freely along the connector; and (v) a plurality of stationary pieces, each containing at least one locking opening, the sides of the locking opening inwardly tapered to create a tight fit with the ends of the dowel shaped connectors;

(b) selecting an initial dowel shaped connector, which has a tapered first and second end, from a group of connectors;

(c) assembling one or more blocks along a dowel shaped connector;

(d) assembling one or more spacers along a dowel shaped connector member;

(e) inserting the first end of the dowel shaped connector into a stationary piece; and (f) inserting the second end of the dowel shaped connector into a hub piece.

12. The method of claim 11 wherein the steps are repeated until the desired structure is completed.

13. The method of claim 12 wherein subsequent connectors are inserted into holes and grooves in the blocks and hubs on the initial dowel shaped connector to build into another plane in order to get a three-dimensional structure.

14. The method of claim 11, further comprising inserting a panel shaped connector into the groove in a hub or block.

15. The method of claim 14, wherein the steps are repeated until the desired structure is completed.

16. The method of claim 15, wherein subsequent connectors are inserted into holes and grooves in the blocks and hubs on the initial dowel shaped connector to build into another plane in order to get a three-dimensional structure.

* * * * *